United States Patent [19]

Ehle et al.

[11] 4,453,254

[45] Jun. 5, 1984

[54] HIGH CURRENT CONDUIT SYSTEM FOR ELECTRICAL FURNACES

[75] Inventors: Joachim Ehle; Alfred Wagner, both of Essen, Fed. Rep. of Germany

[73] Assignee: Fried. Krupp Gesellschaft mit beschränkter Haftung, Essen, Fed. Rep. of Germany

[21] Appl. No.: 357,675

[22] Filed: Mar. 12, 1982

[30] Foreign Application Priority Data

Mar. 24, 1981 [DE] Fed. Rep. of Germany ..... 3111485

[51] Int. Cl.[3] ..... H05B 7/10

[52] U.S. Cl. ..... 373/93

[58] Field of Search ..... 373/99, 93, 91, 92, 373/98

[56] References Cited

U.S. PATENT DOCUMENTS 824,153 6/1906 Seward .

3,686,421 8/1972 Wunsche et al. ..... 373/99

4,168,392 9/1979 Prenn ..... 373/93

FOREIGN PATENT DOCUMENTS 808737 7/1951 Fed. Rep. of Germany .

1565382 1/1970 Fed. Rep. of Germany .

2918757 11/1979 Fed. Rep. of Germany .

2176546 11/1973 France .

*Primary Examiner*—Roy N. Envall, Jr.

*Attorney, Agent, or Firm*—Spencer & Frank

[57] ABSTRACT

In this system, the electrode supporting arms (2) formed of a closed, hollow, liquid cooled profile for an electric furnace are provided with a vertical member (14) having the same type profile structure at whose lower end the electrode (17) is exchangeably fastened, preferably by means of a clamping device (15). For better current transfer, the supporting arms (2) are in part made of a two-component compound material, preferably to correspond to their current charges.

15 Claims, 10 Drawing Figures

19
55
42
23
56
33
2
43
40
39
34
44
48
41
37
35
36
14
54
47
57
46
58
45
52
38
28

HIGH CURRENT CONDUIT SYSTEM FOR ELECTRICAL FURNACES

BACKGROUND OF THE INVENTION

The invention relates to a high current conduit system for electrical furnaces, the system comprising at least one liquid cooled, essentially horizontal electrode supporting arm formed of a closed hollow profile and serving as a current conductor.

In the prior art electrical furnaces, the high current lines are generally arranged in the region of the electrode supporting arms above and parallel to these arms. Because of the heat generated by the induced currents, the supporting arm, which is made of steel or a nonmagnetic material, is usually water-cooled as are the copper pipes. Such a system is expensive to install and operate. It has therefore been proposed to utilize the supporting arm as a current conductor and to surround it for this purpose with a sleeve of a material having good conductivity (DE-OS No. 1,565,382). Such a supporting arm is then provided, at the furnace end, with known electrode clamps which hold the electrodes and which must be loosened when the electrodes are adjusted. These electrode clamps are a significant weak point in a current conduit system because it is difficult to simultaneously realize with them good current transfer without damaging the electrode. Moreover, the frequent resetting of the electrodes requires undesirably long interruptions of operation.

SUMMARY OF THE INVENTION

It is therefore the object of the invention to provide a high current conduit system of the above-mentioned type which makes it possible to quickly and safely grip the electrode and to reduce losses in the electrical conduit system. The above object is achieved according to the present invention by a high current conduit system for electrical furnaces which comprises: at least one essentially horizontal, liquid cooled electrode supporting arm having a downwardly extending vertical member, with the supporting arm and the vertical member being formed with a closed, hollow profile; a guide column disposed outside of the furnace housing on which the supporting arm is supported; an electrode having approximately the same cross section as the vertical member; a threaded member with a conical thread extending from one end of the electrode; and means for exchangeably fastening the electrode via the threaded member to the lower end of the vertical member, with the means for exchangeably fastening including a connection member provided with a conical thread which corresponds to and engages the conical thread of the threaded member, and clamping means, disposed within the vertical member, for releaseably engaging the connecting member to fasten the electrode to the vertical member and press the one end of the electrode against a lower annular outer surface of the vertical member.

The advantages realized with the present invention are primarily the economical manner in which the novel high current conduit system is manufactured and its space saving design. With these features, it has become possible to increase the vertical height of the entire system, which is generally determined by the size of the electrode guide column, and thus to extend the length of the electrode resetting intervals.

Resetting by means of electrode clamps is replaced in the novel system by the exchange of spent electrodes. This provides a firm seat and thus good current transfer at the point of connection. Due to the fact that the vertical portion of the electrode supporting arm, which has the same cross section, extends through the cover of the furnace into the furnace interior, it is possible to consume the electrode almost completely.

It is of particular advantage for the electrode to be provided, via a screwed-in nipple, with a connecting member for the fastening means of a clamping device. The connecting member is first screwed onto the prepared, new electrode and is clamped tight in the shortest time possible by means of the spreading cone of the clamping device so that the electrode and the clamping device are held tight. The release of the remainder of the electrode to be removed is just as simple and quick. The connecting member remaining on the remainder of the electrode can be reused.

Further advantageous embodiments of the invention are defined in the other dependent claims.

BRIEF DESCRIPTION OF THE DRAWINGS

In the drawings, which will be explained in greater detail below, a plurality of embodiments of the invention are represented schematically. The individual figures show.

DETAILED DESCRIPTION OF THE PREFERRED EMBODIMENTS

Figure 1:
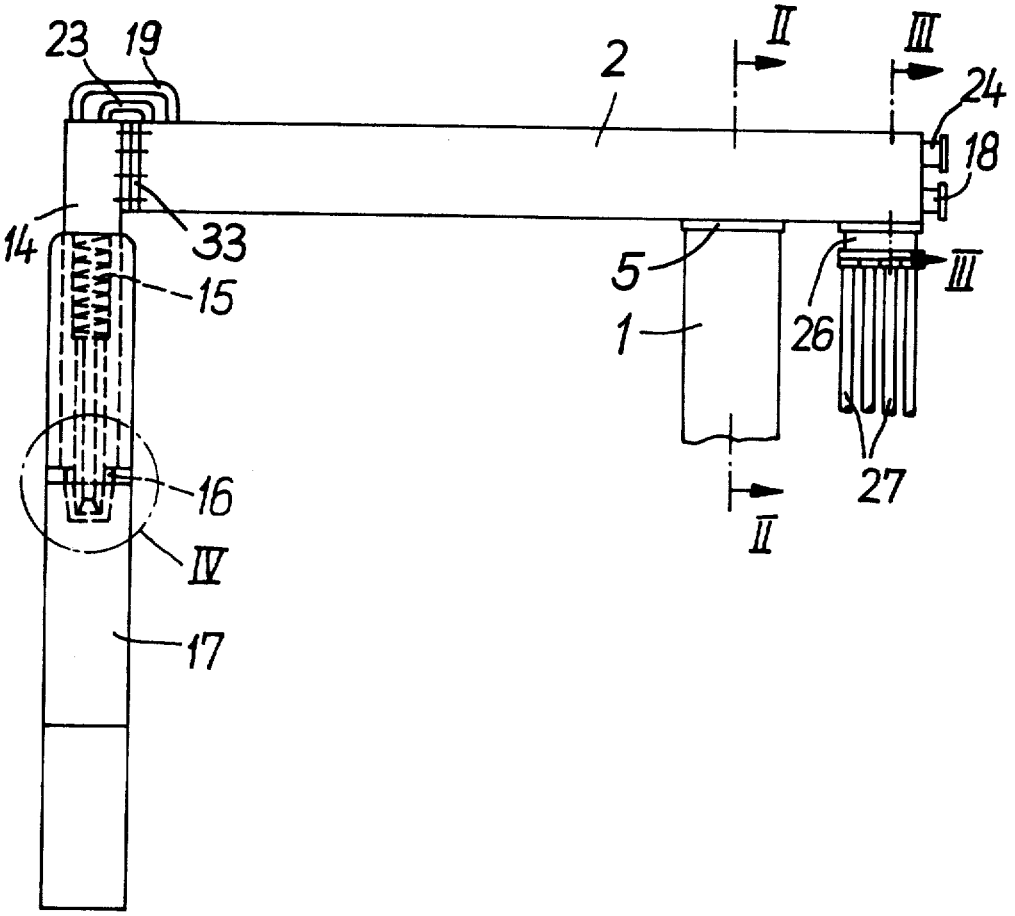
FIG. 1, a front view of an electrode supporting arm.
Figure 2:
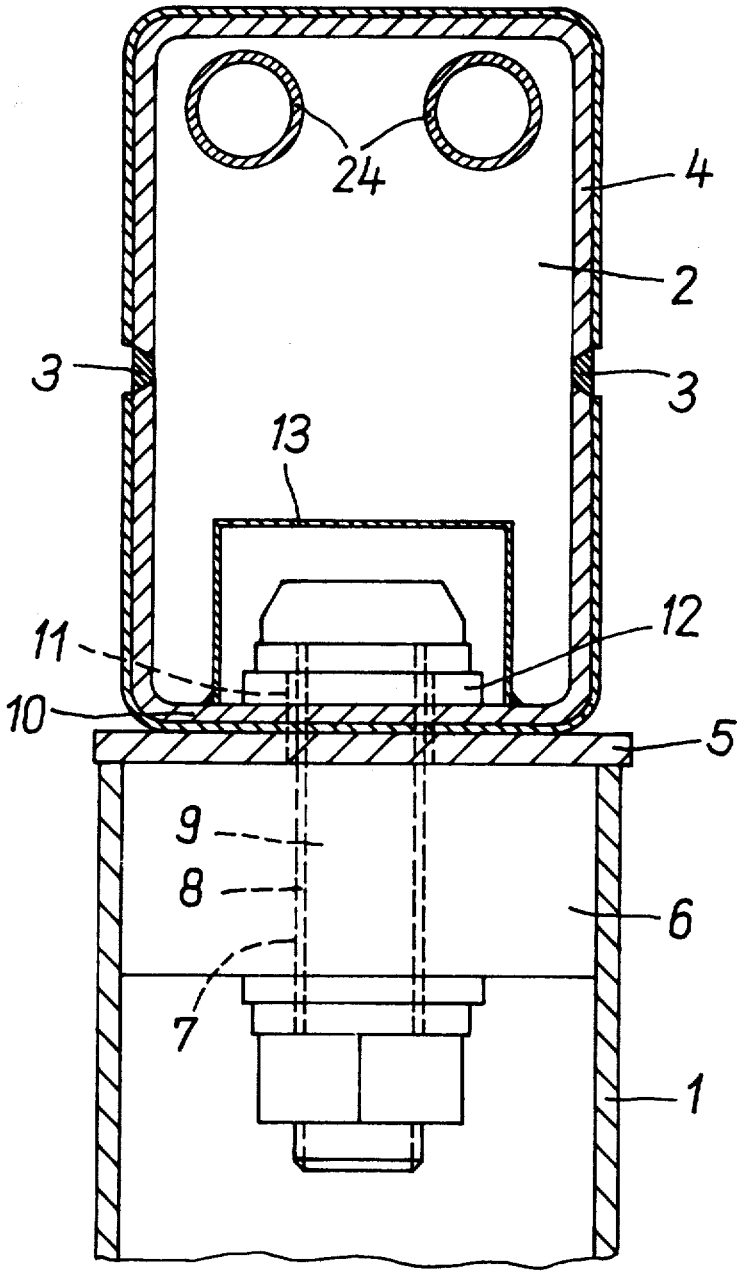
FIG. 2, a sectional view along line II—II of FIG. 1.

As shown in FIGS. 1 and 2, the supporting arm 2, which is fastened to the electrode guide column 1, has the cross section of an upright rectangle whose four corners are rounded. The closed hollow profile of the supporting arm 2 is composed of two sheets of a copper-steel compound material extending practically over the entire length of the arm in such a manner that at each end a longitudinal seam 3 is formed so that only the steel is welded as the supporting internally located component 4. The externally located component of the compound material is made of copper and need not be welded since it performs only a current conducting function, at least over a significant length of the electrode supporting arm 2. The compound material permits the use of a particularly favorable combination of mechanical supporting behavior and electrical conducting behavior.

FIG. 2 shows how fastening and insulation between the supporting arm 2 and the electrode guide column 1 have been accomplished. The upper end of the electrode guide column 1 is provided with an insulating plate 5 and a lining piece 6, each provided with two vertical bores 7 through which hammerhead screws 9 surrounded by insulating sheaths 8 are inserted from the top. Concentric with bores 7, long holes 11 are provided in the lower plate 10 of the electrode supporting arm 2, through which the head of the hammerhead screw 9 fits in a known manner to be subsequently rotated about 90° so as to fasten it. Between the head of the hammerhead screw and the plate 10, there is provided a disc 12 of insulating material which is likewise provided with a long hole. Within the electrode supporting arm, the hammerhead screws are covered by a sealing housing 13.

Figure 4:
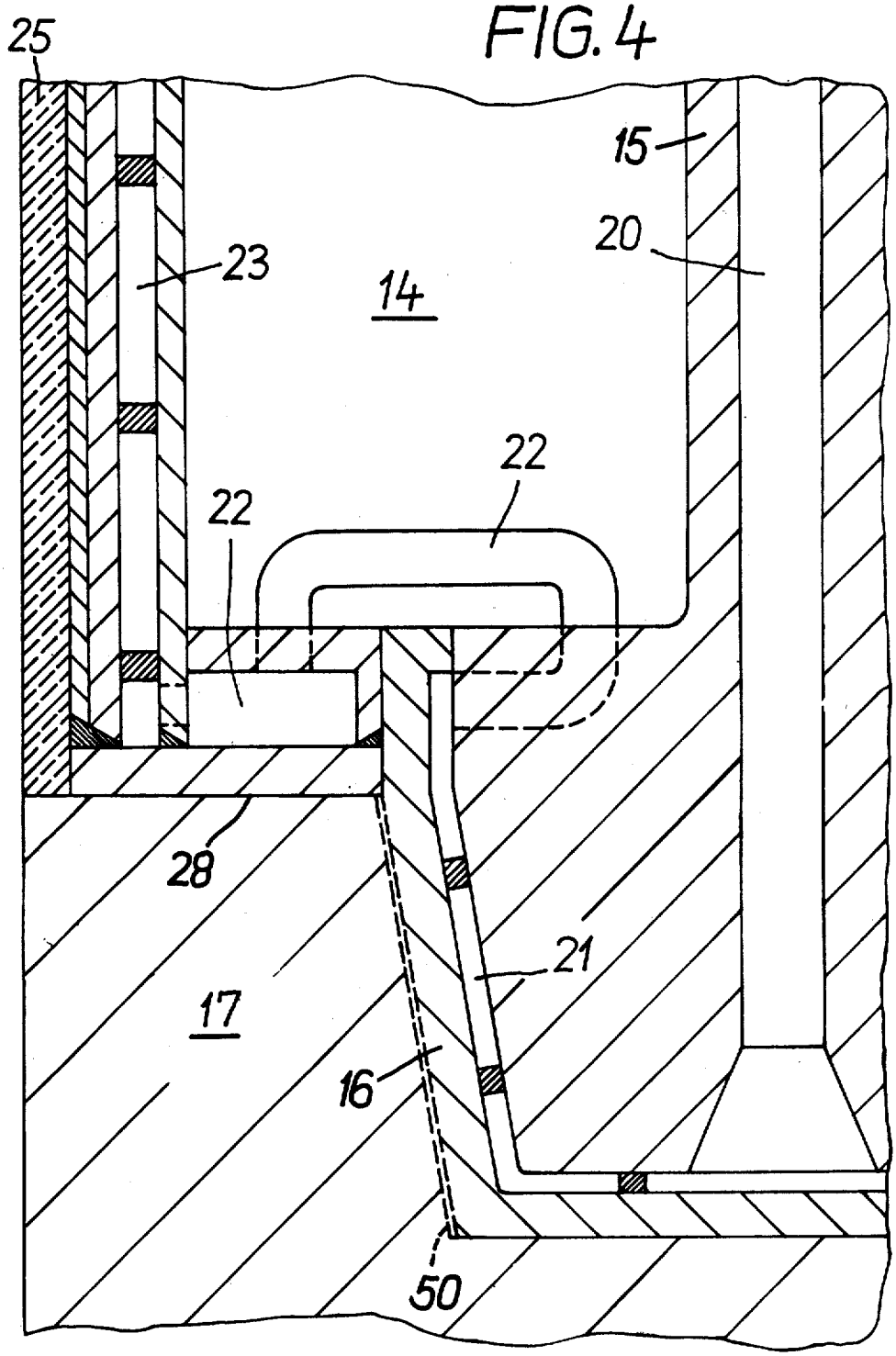
FIG. 4, a detail IV of FIG. 1 in an enlarged sectional view.

At the side of the furnace, the supporting arms 2 are each provided with an identically designed vertical member 14 which, in the lowered state, extends into the furnace (not shown). The vertical member 14 is flanged to the supporting arm 2 in such a manner that transfer of electrical current is assured. The latter is always the case, for example, if the vertical member is welded to the supporting arm 2, as is the case in a further embodiment. Member 14 is provided with a clamping device 15 for a clamping nipple 16 which holds the graphite electrode 17 and thus presses against a lower annular exterior face 28 of the vertical member 14 where the current transfer to the electrode 17 essentially takes place (FIG. 4).

The electrode supporting arm 2 as well as the vertical member 14 are water cooled. The cooling water is introduced into the interior of the supporting arm 2 through connections 18 on the side facing away from the furnace and travels through guide channels 19 into the interior of the vertical member 14 and from there through a central channel 20 of the clamping nipple 16, through further channels 21, 22 and 23 back into the supporting arm 2, where it is conducted through channel 24 and exits again at the end facing away from the furnace. As shown in FIG. 4, the compound material of the vertical member 14 is covered on the outside with a jacket 25 of refractory material. The vertical member 14 permits a reduction in the length of the graphite electrode which, on the one hand, improves the resonant behavior of the system and, on the other hand, facilitates removal of the electrode by means of the clamping device 15.

Figure 3:
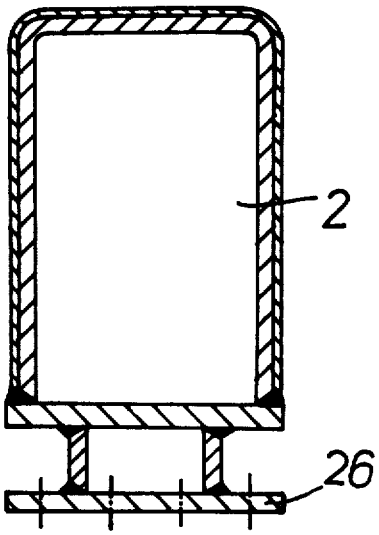
FIG. 3, a sectional view along line III—III of FIG. 1.

At the end of the supporting arm 2 facing away from the furnace, there is fastened in a well conducting manner a connecting flange 26 for the flexible high current cables 27 (FIG. 3).

If the supporting arms 2 have different lengths, as is the case normally, for example, with electrodes that are arranged in a triangle, the two longer supporting arms have a greater moment of inertia or resistance than the shorter supporting arm. This is accomplished most easily in a known manner by increasing the height of the supporting arm cross section.

Figure 5:
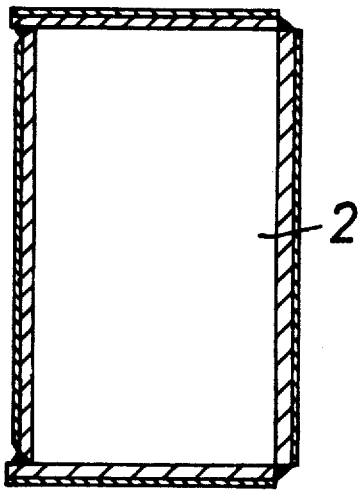
FIGS. 5 and 6, cross-sectional views of different embodiments of the electrode supporting arm.
Figure 6:
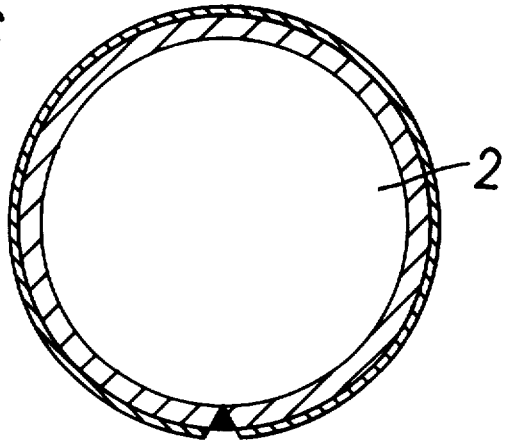

FIG. 5 shows an embodiment in which the supporting arm 2 is composed of four plates which are welded together at the corners of the profile. Here, as in the supporting arm having a circular cross section as shown in FIG. 6, only the inner supporting component, which is made of ferritic or austenitic steel, is welded. Of course, depending on expedience, other profile cross sections, for example constricted designs, may also be selected for the supporting arm 2 and the vertical member 14.

Figure 7:
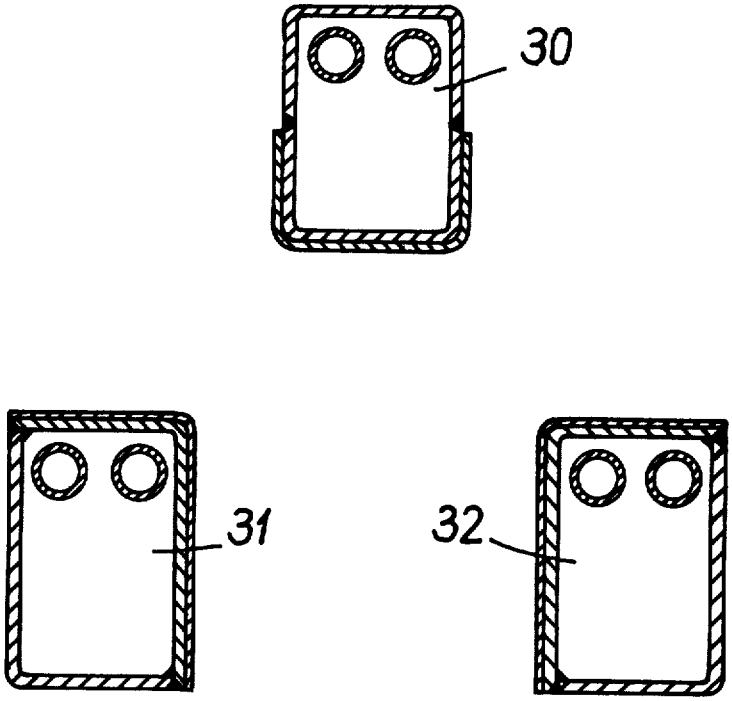
FIG. 7, a vertical sectional view through an arrangement of three supporting arms arranged in a triangle.

In the embodiment of FIG. 7, the electrode supporting arms 2 are arranged in such a manner that one supporting arm 30 lies higher than the other two supporting arms 31, 32. In this three-phase high current conduction system the compound material is used only for the walls of the supporting arms which face one another because only these walls are primarily charged with current. This saves on expensive material. Thus, in the supporting arm 30 only the lower half is made of the compound material while in supporting arms 31 and 32 the inner and upper walls are made of the compound material. The members made of the compound material each have an appropriately chamfered section whose steel component is welded to the steel material of the respectively nextfollowing wall sections.

Figure 8:
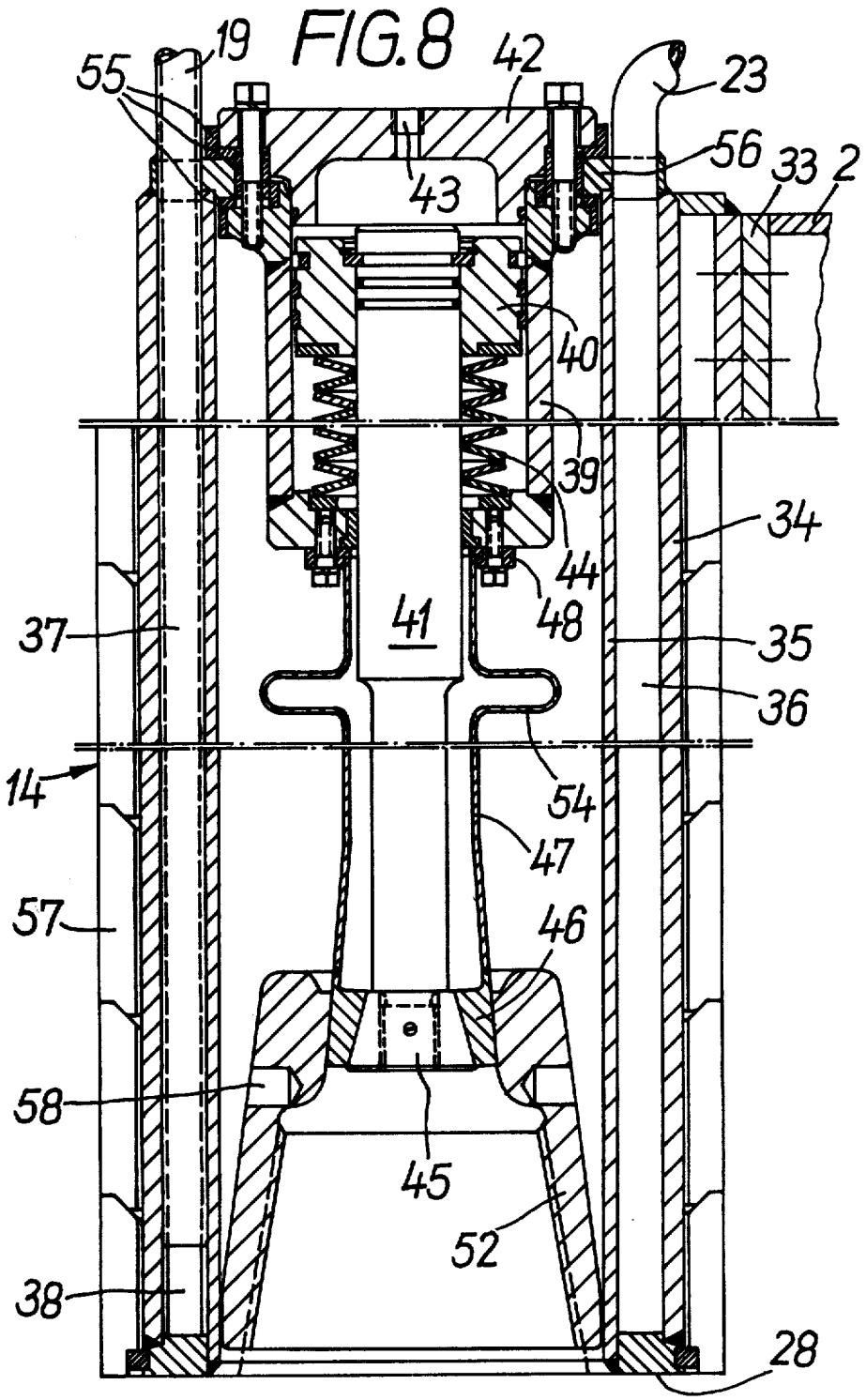
FIG. 8, a vertical sectional view of the vertical member of an electrode supporting arm in its center plane.

FIG. 8 shows an embodiment of the vertical member 14 which is connected with the electrode supporting arm via a flange 33 and is equipped with a water chargeable cooling jacket. The cooling jacket is formed by a vertical annular chamber 36 formed between an exterior pipe 34 and an interior pipe 35. In the annular chamber 36, eight tubular inlet channels 37 are arranged in a uniform distribution over the circumference so as to extend over the entire length of the annular chamber 36. The inlet channels 37 have their upper ends connected to the guide channels 19 which bring in the cooling water through the supporting arm 2. The lower ends of the inlet channels are provided with lateral discharge openings 38 through which the incoming cooling water flows into annular chamber 36 and is then conducted away again through channels 23 which are connected to the top of the annular chamber 36 and through the connected channels 24 and the supporting arm.

In the upper portion of the vertical member 14, there is provided a coaxial cylinder 39 in which a pull rod 41, which projects from its bottom and is provided with a piston 40 at its upper end, is displaceably guided. The upper end of the cylinder 39 is closed by a screwable flange cover 42 which is connected, via a bore 43, to a pressurized oil inlet. The annular chamber 44 of cylinder 39 disposed below the piston 40 is provided with plate springs 44 which are supported by the cylinder at the bottom and by the piston at the top. The lower end of the pull rod 41 has an upwardly tapered spreading member or cone 45 which is surrounded by an annular expanding or spreading cone that is comprised of a plurality of segments 46 which are uniformly distributed over its circumference. The segments 46 are attached by welding to a pipe 47 which serves as mount and which is coaxial with the pulling rod or clamp 41. The upper end of pipe 47 is screwed to the cylinder 39 via a flange 48. The lower end of pipe 47 is conically widened and is provided with longitudinal slits 49 between the individual segments 46 in such a manner that resilient radial movement of segments 46 becomes possible.

Figure 9:
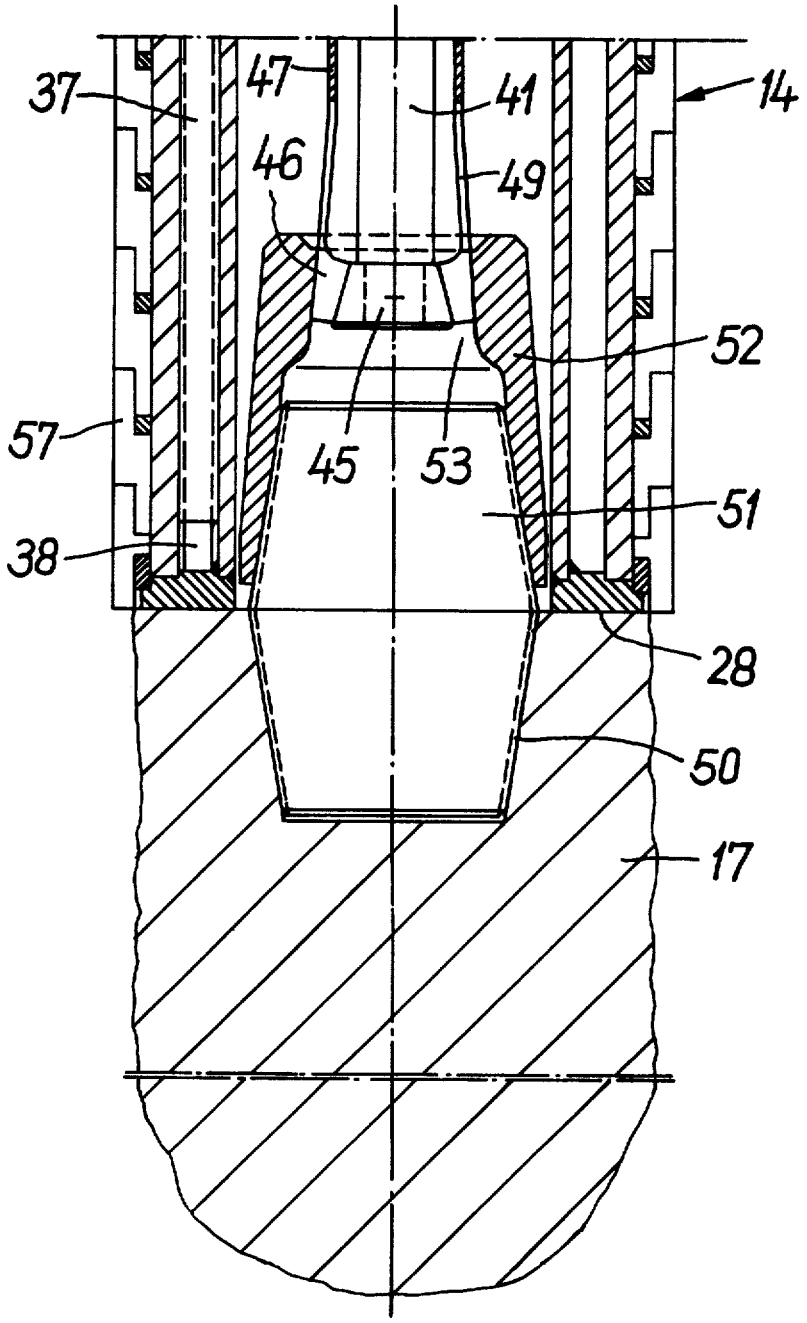
FIG. 9, a vertical sectional view of an electrode connected to the vertical member.

As shown in FIG. 9, the electrode 17 is provided at its connecting end with a conical, threaded bore 50 into which is screwed a double cone nipple 51 having a thread over its entire exterior. A nipple cap 52 provided with a corresponding internal thread is screwed into the projecting end of nipple 51 so as to serve as a connecting member for fastening the electrode 17 to the vertical member 14. The nipple cap 52 is a rotationally symmetrical member and its other end, which is not provided with internal threads, has a central conical bore 53 which is tapered toward the outside. Moreover, at its exterior, the nipple cap 52 has two oppositely disposed blind holes 58 which serve as a means for attaching a lifting tool.

The exchange of the electrodes takes place as follows: in order to release the upper spent electrode remainder 17, the frontal faces of pull rod 41 and piston 40 are charged with pressure via inlet 43 causing same to thus be moved downwardly, thereby releasing segments 46 which, due to the inherent resilience of these tongue-like members at the lower end of pipe 47, move inwardly at least far enough to release the narrowest portion of bore 53. The electrode remainder together with nipple 51 and nipple cap 52 can then be pulled out toward the bottom. In its place, a new electrode, likewise provided with a nipple 51 and a screwed-on nipple cap 52, is introduced into the connecting end of the vertical member 14 so that the upper annular frontal face of electrode 17 rests against the lower annular exterior face 28. This simultaneously pushes bore 53 over the spreading cone 45 and the segments 46. Together with the subsequently performed oil pressure release, the pull rod 41 is moved upwardly again by the pressure of the plate springs 44 and initially causes the spreading cone 45, press the segments 46 against the conical bore 53 of the nipple cap 52, and then the annular frontal face of electrode 17 to be pressed against the exterior face 28. This completes the exchange process. For possibly required adaptation movements of the annular spreading cone in the axial direction, there is provided a length compensator 54 in pipe 47.

Due to the fact that practically no soiling occurs at the exterior faces 28, and the clamping device produces a firm seat for the electrode 17, good current transfer is assured. In the vertical member, current flows essentially through the exterior pipe 34 which may also be made wholly or in part of the compound material and a slight portion passes through the interior pipe 35. The clamping device is insulated with respect to the current conducting pipes 34 und 35 by annular bodies 55 of insulating material which are arranged between the cover 42 and the cylinder 39, on the one hand, and its mounting flange 56, on the other hand. The lower region of the exterior pipe 34 is enclosed by a jacket 57 of insulating material which is composed of interchangeable rings made of an impact resistant ceramic material. With such an insulation, consumption of cooling water is reduced.

Figure 10:
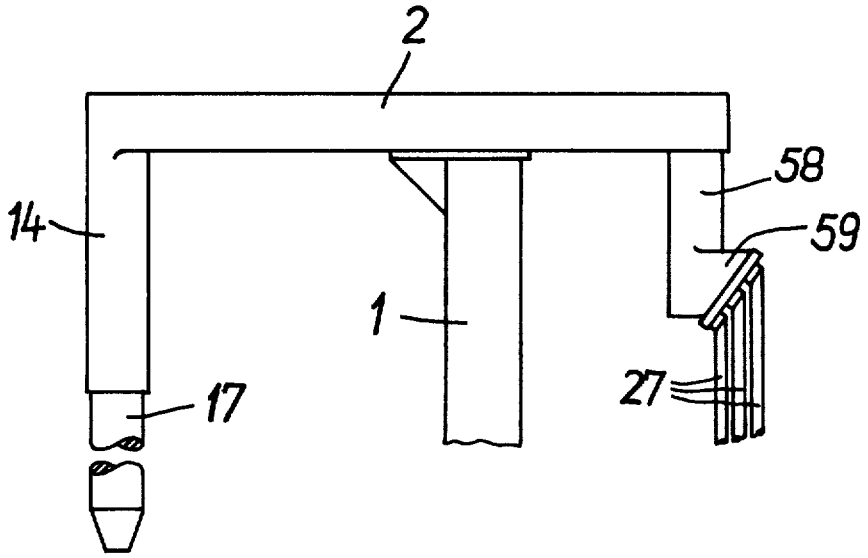
FIG. 10, an electrode supporting arm which is provided with a further vertical member at its end facing away from the furnace.

FIG. 10 shows an embodiment of the novel system in which the electrode supporting arm 2, at its end facing away from the furnace, is provided with a further tubular vertical member 58 which is welded to the underside of the supporting arm. At its lower end, the exterior of the vertical member 58 is provided with a welded-on flange console 59 for the connection of the high current cables 27. This further vertical member results in a further improvement of the reactance symmetry of the system even if the member is of relatively short length, so that its suitable length can depend on the respective local and structural conditions, e.g. the size of the furnace, the position of cables and transformer or the operating panel.

The material or compound material employed for the electrode supporting arm and for the two vertical members depends, in addition to the desired supporting behavior, mainly on whether direct, alternating or three-phase current is used. While for direct current a simple structural steel (carbon content) is often already suitable, for use with alternating current, nonmagnetic, chromium alloyed, stainless steels are well suited in addition to the compound materials, e.g. those made of Al and steel or preferably Cu and steel.

We claim:

1. A high current conduit system for electrical furnaces comprising: at least one essentially horizontal, liquid cooled electrode supporting arm having a downwardly extending vertical member, with said supporting arm and said vertical member each being formed with a closed hollow-profile; a guide column which is disposed outside of the furnace housing and on which said supporting arm is supported; an electrode having approximately the same cross section as said vertical member; an electrode nipple with an external conical thread extending from one end of said electrode; and means for exchangeably fastening said electrode via said electrode nipple to the lower end of said vertical member, said means for exchangeably fastening including a; connecting member having a conical interior thread which engages said thread of said electrode nipple at one end thereof and a coaxial, outwardly tapering conical bore at its other end, and clamping means, disposed within said vertical member, for releaseably engaging said connecting member to fasten said electrode to said vertical member and press said one end of said electrode against a lower annular outer surface of said vertical member, said clamping means including a spreading cone means which extends into said conical bore for engaging said connecting member to fasten same to said vertical member.

2. A system as defined in claim 1, wherein: said clamping means further includes an axially displaceable pull rod mounted within said vertical member; and said spreading cone means is disposed adjacent the lower end of said pull rod and includes an annular expanding cone mounted within said vertical member and a mating spreading cone fastened to the lower end of said pull rod for charging said annular expanding cone with pressure in a direction from the interior toward the exterior of said expanding cone.

3. A system as defined in claim 2 wherein said clamping means further includes: a cylinder coaxially mounted within said vertical member; a piston connected to the upper end of said pull rod and moveable within said cylinder; and means for applying pressure to said piston from both sides whereby said pull rod can be selectively moved upwardly or downwardly.

4. A system as defined in claim 3 wherein said means for applying pressure to said piston includes a spring mounted to apply pressure to the bottom of said piston and means for selectively applying a pressure medium to the top of said piston.

5. A system as defined in claim 3 or claim 4 wherein said annular expanding cone includes a plurality of segments disposed at the lower end of a tubular mount which is provided with a length compensator means; and means are provided for fastening the upper end of said tubular mount to said cylinder.

6. A system as defined in claim 1 wherein said vertical member is provided with a cooling jacket; and wherein a plurality of inlet channels for a coolant are arranged in said cooling jacket in a downward orientation, with said inlet channels having their upper ends connected with a coolant inlet and having their lower ends provided with respective exit openings.

7. A high current conduit system for electrical furnaces comprising: at least one essentially horizontal, liquid cooled electrode supporting arm having a downwardly extending vertical member, with said supporting arm and said vertical member each being formed with a closed hollow-profile; a guide column which is disposed outside of the furnace housing and on which said supporting arm is supported; an electrode having approximately the same cross section as said vertical member; a threaded member with a conical thread extending from one end of said electrode; and means for exchangeably fastening said electrode via said threaded member to the lower end of said vertical member, said means for exchangeably fastening including a connecting member provided with a conical thread which corresponds to and engages said conical thread of said threaded member, and clamping means, disposed within said vertical member, for releaseably engaging said connecting member to fasten said electrode to said vertical member and press said one end of said electrode against a lower annular outer surface of said vertical member; and wherein each said electrode supporting arm serves as a current conductor for the associated said electrode, and is made, at least in part, of a compound material which comprises an essentially supporting internal component and an essentially current conducting external component.

8. A system as defined in claim 7, wherein each said electrode supporting arm is composed of compound material in the form of plated sheet metal which is arranged such that seams are provided which extend essentially only in the longitudinal direction of said supporting arm.

9. A system as defined in claim 8, wherein said internal component is welded at said longitudinal seams but the longitudinal seams of said external component are not welded.

10. A system as defined in claim 7 wherein said compound material, from of which said supporting arm is made, is a copper-steel compound material, with copper comprising said outer component.

11. A system as defined in claim 7 wherein each said electrode supporting arm is made of said compound material essentially only in those regions which are primarily charged with current.

12. A system as defined in claim 11 for electrical furnaces having three electrodes and three of said supporting arms wherein: the axes of said supporting arms, which each have a rectangular cross section, are arranged in a triangle in symmetry with respect to the center supporting arm; wherein, with respect to their cross section, only one half of the wall of each supporting arm is made of said compound material; and wherein said compound material is disposed at the respective sides of said supporting arms facing one another, such that the upper or lower half, respectively, of said center supporting arm, and the inner half delimited by the respective diagonal of the two remaining outer supporting arms are made of said compound material.

13. In a high current conduit system for electrical furnaces comprising: at least one essentially horizontal, liquid cooled electrode supporting arm having a downwardly extending vertical member, with said supporting arm and said vertical member each being formed with a closed hollow-profile; a guide column disposed outside of the furnace housing on which said supporting arm is supported; an electrode having approximately the same cross section as said vertical member; a threaded member with a conical thread extending from one end of said electrode; and means for exchangeably fastening said electrode via said threaded member to the lower end of said vertical member, said means for exchangeably fastening including a connection member provided with a conical thread which corresponds to and engages said conical thread of said threaded member, and clamping means, disposed within said vertical member, for releaseably engaging said connection member to fasten said electrode to said vertical member and press said one end of said electrode against a lower annular outer surface of said vertical member; the improvement wherein said system is for an electrical furnace having electrodes arranged in a triangle, and includes three of said supporting arms; and wherein the longer of said supporting arms have a greater inertial moment than the shorter of said supporting arms.

14. A high current conduit system for electrical furnaces comprising: at least one essentially horizontal, liquid cooled electrode supporting arm having a downwardly extending vertical member, with said supporting arm and said vertical member each being formed with a closed hollow-profile; a guide column disposed outside of the furnace housing on which said supporting arm is supported; an electrode having approximately the same cross section as said vertical member; a threaded member with a conical thread extending from one end of said electrode; means for exchangeably fastening said electrode via said threaded member to the lower end of said vertical member, said means for exchangeably fastening including a connection member provided with a conical thread which corresponds to and engages said conical thread of said threaded member, and clamping means, disposed within said vertical member, for releaseably engaging said connection member to fasten said electrode to said vertical member and press said one end of said electrode against a lower annular outer surface of said vertical member; and, a further, downwardly extending vertical member formed with a closed, hollow profile provided at the end of said electrode supporting arm facing away from the furnace.

15. A system as defined in claim 14 wherein said further vertical member is shorter than said vertical member to which said electrode is fastened.

* * * * *